US005816214A

United States Patent [19]

Kinugasa et al.

[11] Patent Number: 5,816,214

[45] Date of Patent: Oct. 6, 1998

[54] EMISSION CONTROL SYSTEM FOR AN AUTOMOBILE

[75] Inventors: Yukio Kinugasa, Susono; Toru Kidokoro, Hadano; Takaaki Itou, Misima, all of Japan

[73] Assignee: Toyota Jidosha Kabushiki Kaisha, Toyota, Japan

[21] Appl. No.: 622,372

[22] Filed: Mar. 27, 1996

[30] Foreign Application Priority Data

Apr. 4, 1995 [JP] Japan ..... 7-078906
Mar. 18, 1996 [JP] Japan ..... 8-061180

[51] Int. Cl.[6] ..... F02M 35/10
[52] U.S. Cl. ..... 123/198 E
[58] Field of Search ..... 123/198 E, 572, 123/573, 544

[56] References Cited

U.S. PATENT DOCUMENTS 4,237,840 12/1980 Figueiras .

FOREIGN PATENT DOCUMENTS 2 078 425 11/1971 France .
61-107614 7/1986 Japan .
2-136557 5/1990 Japan .
WO 85/02885 7/1985 WIPO .

*Primary Examiner*—Marguerite McMahon
*Attorney, Agent, or Firm*—Oliff & Berridge, PLC

[57] ABSTRACT

The emission control system of the present invention removes the small amounts of polluting gases released from various parts of the automobile. These polluting gases are released from, for example, fuel oozing out from connections of the pipes in the fuel system, lubricating oil oozing out from engine body, and solvents and adhesives remaining in the interior and exterior parts of the automobile. In the emission control system of the present invention, collectors and suction pipes are provided. The collectors are disposed at the parts of the automobile from where the polluting gases are released in such a manner that the collectors enclose these parts. The suction pipes connect the respective collectors to an intake nose of an air cleaner disposed in an intake air passage of the engine. Therefore, the polluting gases released from various parts of the automobile are drawn into the engine through the respective suction pipes before they diffuse into the atmosphere, and are burned in the engine. Thus, according to the present invention, the polluting gases released from various parts of the automobile are prevented from diffusing into the atmosphere.

20 Claims, 12 Drawing Sheets

SECTION A-A

SECTION C-C

EMISSION CONTROL SYSTEM FOR AN AUTOMOBILE

BACKGROUND OF THE INVENTION

1. Field of the Invention

This invention relates to an emission control system for an automobile and, more particularly, relates to an emission control system which is capable of preventing polluting gases released from various parts of the automobile from diffusing into the atmosphere.

2. Description of the Related Art

An emission control system which is capable of preventing fuel vapor in a fuel tank from being released into the atmosphere is commonly used in automobiles. For example, Japanese Unexamined Patent Publication (Kokai) No. 2-136557 discloses an emission control system of this type. The emission control system in the '557 publication feeds the fuel vapor in the fuel tank to an intake air passage of the engine. The system in '557 publication uses a canister containing an adsorbent. The canister is connected to a space above fuel level in the fuel tank, and to an intake air passage of the automobile. In the system of '557 publication, the fuel vapor in the fuel tank is sent to the canister and adsorbed by the adsorbent. During the engine operation, air is introduced into the canister through an air inlet hole provided on the canister. The air introduced in the canister purges the fuel vapor from the adsorbent and, a mixture of the fuel vapor and air is inhaled by the engine through the intake air passage. Further, in the system in '557 publication, the air inlet hole of the canister is connected to the intake air passage of the engine. Therefore, even if the adsorbent is saturated with the fuel vapor, the fuel vapor which is not adsorbed by the adsorbent and flows out from the air inlet hole is lead to the intake air passage. Thus, the fuel vapor does not diffuse into the atmosphere even when the adsorbent is saturated with the fuel vapor.

Though the emission control system in the '557 publication is directed to only the prevention of diffusion of the fuel vapor in the fuel tank into the atmosphere, other polluting gases such as hydrocarbons can be released from various parts of the automobile other than the fuel tank. For example, when the elements in the fuel system of the engine, such as fuel pump or connections of fuel pipes, have small leaks, a small amount of hydrocarbons are released to the atmosphere from these parts due to the evaporation of the leaked fuel. The system in the '557 publication cannot prevent diffusion of hydrocarbons into the atmosphere caused by a leak in the fuel system.

Further, substances other than fuel, such as lubricants, coolants, and hydraulic fluids used in the automobile also release hydrocarbons. In addition, polluting gases other than hydrocarbons can be released from the automobile. For example, if a leak occurs in the elements of the air conditioning system of the automobile, such as compressor or refrigerant pipes, refrigerant gas can be released to the atmosphere.

As an emission control system which is directed to the prevention of diffusion of polluting gases other than the fuel vapor from a fuel tank, a crankcase emission control system is commonly used. The crankcase emission control system is used for purging the blow-by gas in the crankcase of an engine into the intake air passage of the engine. However, since the amounts of the polluting gases released from the parts of the automobile are very small compared to the fuel vapor in the fuel tank or blow-by gas in the crankcase, no countermeasure for preventing these polluting gases from diffusing in the atmosphere has been considered heretofore.

SUMMARY OF THE INVENTION

In view of the problems set forth above, the object of the present invention is to provide an emission control system for an automobile which is capable of preventing the pollutant gases released from the parts of the automobile into the atmosphere from diffusing into the atmosphere.

The above-mentioned object is achieved by an emission control system according to the present invention, in which the system comprises a suction pipe connected to an intake air passage of an engine of the automobile and extended to a part of the automobile from where polluting gases are released. The suction pipe is provided with an aperture facing the surface of the part of the automobile from where the polluting gases are released with close clearance therebetween, thereby the polluting gases released from the part and ambient air around the part are drawn into engine through the aperture and the suction pipe when the engine is operated.

According to the present invention, the polluting gases released into the atmosphere from the part of the automobile are immediately drawn into the suction pipe through the aperture thereof, and fed to the engine through the intake air passage. Therefore, since the polluting gases flow into the engine before they diffuse into the atmosphere, and are burned in the engine, diffusion of the polluting gas into the atmosphere is prevented from occurring.

BRIEF DESCRIPTION OF THE DRAWINGS

The present invention will be better understood from the description as set forth hereinafter, with reference to the accompanying drawings in which.

DESCRIPTION OF PREFERRED EMBODIMENTS

Figure 1:
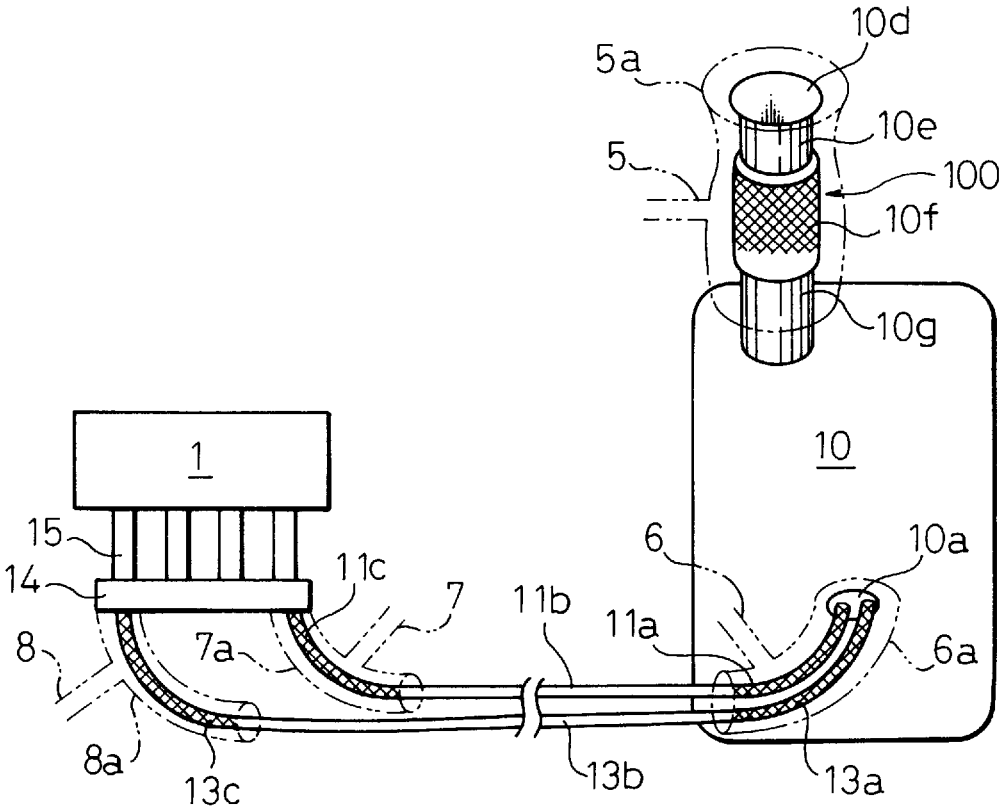
FIG. 1 and FIG. 2 are drawings schematically illustrating an embodiment of the emission control system according to the present invention which is directed to the prevention of diffusion of polluting gases released from the fuel system of the engine.

Embodiments of the present invention will be explained with reference to the accompanying drawings.

In the present invention, polluting gases released from various parts of automobile, which cannot be removed by the conventional emission control system using a canister or the crankcase emission control system, are prevented from diffusing into the atmosphere. Generally, the following substances used in automobiles are considered to be sources of polluting gases such as hydrocarbons released from automobiles.

(1) Fuel of the engine (gasoline or diesel fuel).

(2) Blow-by gas of the engine.

(3) Lubricating oil of the engine.

(4) Transmission oil used in the drive system of the automobile.

(5) Lubricants and oils used in the chassis system of the automobile, for example, lubricating oil and grease applied to sliding parts in the chassis system and working fluid in the hydraulic mechanism used in the chassis system.

(6) Brake fluid used in the hydraulic brake system.

(7) Cooling fluid such as a long life coolant used in the engine coolant recirculation system.

(8) Windshield washer liquid used in the windshield washer system.

(9) Refrigerant used in the air conditioning system of the automobile.

(10) Power steering fluid used in the hydraulic mechanism of the power steering system.

(11) Residual solvent in the material of interior and exterior parts of the automobile and, adhesive and paint used for manufacturing these parts.

Each of these sources of the polluting gases is explained hereinafter.

(1) Fuel of the engine (gasoline or diesel fuel).

Polluting gases such as hydrocarbons are released to the atmosphere if the fuel system of the automobile has leaks. Though diffusion of the fuel vapor into the atmosphere is prevented by the conventional emission control system using the canister, diffusion of the polluting gases released from leaked fuel cannot be prevented by the canister. Usually it is very difficult to prevent a very small leak from the connections between the fuel pipes and the equipment in the fuel system (such as a fuel pumps, fuel injection valves, filters and pressure control valves), or the connections between fuel pipes. Further, in some cases, a small amount of fuel may leak from rubber hoses used in the fuel system. Though the amount is very small, the pollutant gases such as hydrocarbons are released from the fuel leaked from these parts and diffuse into the atmosphere. Further, a leakage of fuel may occur at, for example, a seal of a filler cap of the fuel tank, connections between the fuel tank and fuel pipes, or a seal between the cover of a maintenance hole and the fuel tank. In addition to that, in the emission control system using the canister, if the connections between the fuel vapor pipes and the equipment such as a canister, a fuel tank, a purge control valve leak, the fuel vapor in the emission control system is released to atmosphere. Thus, these portions of the fuel system also can be the sources of the polluting gases.

(2) Blow-by gas of the engine.

Blow-by gas, which leaks into the crankcase of engine during compression and explosion strokes through the clearance between piston rings and cylinder walls contains a relatively large amount of hydrocarbons. A large part of the blow-by gas leaks into the crankcase are purged into the intake air passage of the engine by the conventional crankcase emission control system. However a small amount of the blow-by gas sometimes leaks to the atmosphere through the joints between the parts that compose the engine body. For example, blow-by gas may be released to the atmosphere if a leak occurs at the joints between a rocker cover and a cylinder head, a cylinder block and an oil pan. Therefore, these parts can be the sources of polluting gases.

(3) Lubricating oil of the engine.

Similarly to the cases of the blow-by gas, a small amount of lubricating oil may ooze out from the joints between the parts that compose the engine body. Especially, the joints between the rocker cover and the cylinder head, between the cylinder block and the oil pan are prone to leakage of the lubricating oil. If the leaks occur at these parts, the leaked lubrication oil, especially at a high temperature, releases hydrocarbons (i.e., oil vapor) and, can be the source of the polluting gases. Further, since the lubricating oil contacts the fuel and the blow-by gas when circulating in the engine, a relatively large amount of fuel vapor dissolves in the lubricating oil. Therefore, when the lubricating oil leaks from the joints of the engine, the fuel vapor as well as the hydrocarbon components of the lubricating oil are released from the lubricating oil, thereby the lubricating oil can be the source of polluting gases.

(4) Transmission oil used in the drive system of the automobile.

Vapor released from the transmission oil contains polluting gases such as hydrocarbons. Therefore, if leakage of the transmission oil occurs in the drive system of the automobile, such as the transmission and the differential gear box, polluting gases diffuse into the atmosphere.

The leaks may occur, for example, at the portion of the engine where the crankshaft penetrates the cylinder block, at the portions of the transmission and differential gear where the input and output shafts penetrate the casing, at the portions of the transmission where a speedometer cable or a gear shift mechanism are connected. Further, oil vapor containing polluting gases is directly released to the atmosphere from breathers disposed on the casings of the transmission and the differential gear box. Apart from these portions, lubricating oil or grease is usually applied to universal joints and constant velocity joints which connect driving shafts in the drive system each other. If the lubricating oil and grease leak from these portions, polluting gases such as hydrocarbons are released to the atmosphere.

(5) Lubricants and oils used in the chassis system of the automobile.

In the chassis system, there are various parts in which oils or greases are filled or applied. For example, grease is filled in or applied to sliding joints in the suspension mechanism. Therefore, these oils and greases can be the source of the polluting gases. Further, in addition to the sliding joints, working fluids are filled in shock absorbers or, if used, a hydraulic adjusting system in the suspension system. Also, other oil dampers such as those used in the engine hood or rear hatch opening mechanism contain working fluids. Therefore, these parts can be the sources of the polluting gases.

(6) Brake fluid used in the hydraulic brake system.

The brake fluid used in the hydraulic brake system contains hydrocarbons such as glycol ether, and releases the polluting gases. Therefore, when the brake oil oozes out from the elements in the brake system (such as a master cylinder and a wheel cylinder), the polluting gases such as hydrocarbons are released to the atmosphere. Further, when the temperature in the engine compartment becomes high, the vapor of the brake fluid is directly released from the opening of the brake fluid reservoir. Therefore, these parts can be the sources of the polluting gases.

(7) Cooling fluid of the engine such as a long life coolant.

Cooling fluid of the engine contains hydrocarbons such as ethylene glycol and releases polluting gases. Especially, since the temperature of the cooling fluid becomes high during the operation of the engine, a relatively large amount of vapor containing hydrocarbons is released from the opening of a cooling fluid reservoir in the cooling fluid system of the engine. Further, if the cooling fluid oozes out from the connections of cooling fluid pipes, a radiator and compartment heater hoses, cooling fluid vapor is released to the atmosphere. Therefore, these parts can be the sources of the polluting gases.

(8) Windshield washer liquid used in the windshield washer system.

Windshield washer liquid contains a higher alcohol and can release hydrocarbons into the atmosphere. Further, a reservoir for storing the windshield washer liquid is usually disposed in the engine compartment of the automobile. Therefore, since the windshield washer liquid in the reservoir reaches high temperature during engine operation, the vapor of the windshield washer liquid, containing hydrocarbons, is released into the atmosphere from the reservoir. Thus, the windshield washer liquid can be the source of the polluting gases.

(9) Refrigerant used in the air conditioning system.

When the air conditioning system is operated, sometimes a very small amount of refrigerant leaks from the connections of the equipment and refrigerant pipes in the air conditioning system. The refrigerant, such as a chlorofluorocarbon, causes the destruction of ozonosphere of the earth when released into the atmosphere. Therefore, the refrigerant in the air conditioning system can be the source of the polluting gases.

(10) Power steering fluid used in the power steering system.

Power steering system of the automobile uses high pressure power steering fluid. Therefore, leaks may occur at the connections of the pipes and the elements in the power steering system such as high pressure power steering pump, hydraulic actuators and a reservoir of the power steering fluid. The power steering fluid contains hydrocarbons and, when it leaks, it can be the source of polluting gases.

(11) Residual solvent etc.

Many of interior and exterior parts use materials (for example, synthetic resin) which require solvents for production. Further, adhesives and paints which usually contain solvents are used for manufacturing these interior and exterior parts. These solvents remains in the parts for a relatively long time and are released from the interior and exterior parts to the atmosphere. Therefore, these interior and exterior parts can be the sources of the polluting gases. Especially, the solvents are gradually released from the materials and adhesives used for manufacturing the seats of the automobile. Thus, the seats of the automobile can be the source of the polluting gases for a relatively long period. Further, pneumatic tires of the automobile use a large amount of rubber material and, in addition, the tires reaches high temperature when the automobile is running. Therefore, solvents, i.e., polluting gases are released from the tire of the automobile.

As explained above, the polluting gases which is mainly composed of hydrocarbons are released from various parts of the automobile. The amounts of these polluting gases are very small compared to the fuel vapor in the fuel tank. However, in order to completely prevent diffusion of the polluting gases into the atmosphere, these polluting gases released from the parts of the automobile, even though the amount thereof is very small, must be removed before they diffuse into the atmosphere.

In the present invention, as illustrated in the various embodiment explained hereinafter, the polluting gases released from the parts of the automobile are inhaled by the engine through an aperture of a suction pipe and burned by the engine and, thereby, diffusion of the polluting gases into the atmosphere is prevented from occurring.

Figure 2:
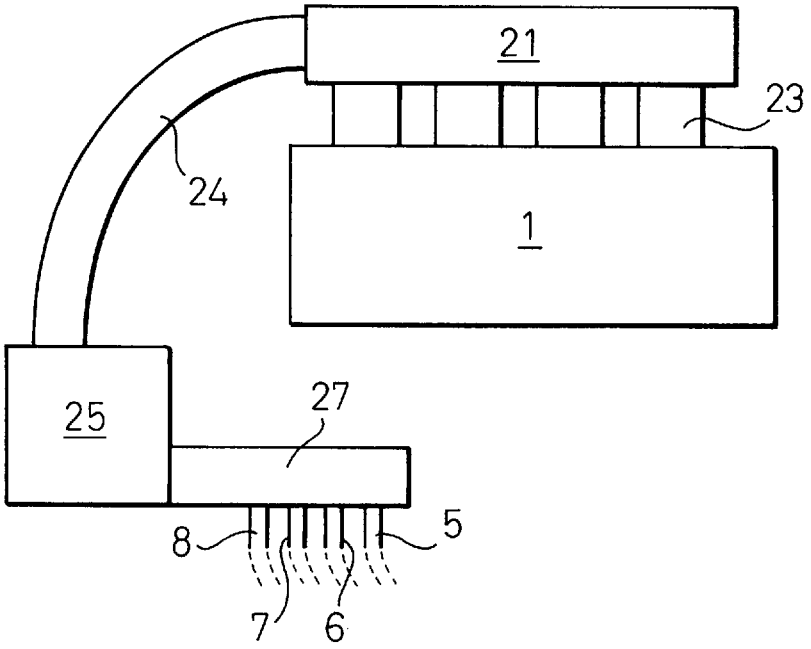

FIGS. 1 and 2 schematically illustrate an embodiment of the emission control system according to the present invention in which diffusion of the polluting gases caused by the leaked fuel is prevented by the aperture of the suction pipe disposed near the fuel system of the automobile. In FIG. 1, reference numeral 1 designates an engine of the automobile, numerals 10 and 10*a* designate a fuel tank and a cover of a maintenance hole thereof, respectively. The fuel in the fuel tank 10 is supplied to a common delivery pipe 14 through a fuel supply pipes 11*a* through 11*c* via a fuel pump not shown in the drawing. The fuel pipe 11*a* extends from the cover 10*a* of the maintenance hole of the fuel tank 10. A part of the fuel supplied to the delivery pipe 14 is injected to the respective cylinders of the engine by fuel injection valves 15 (in FIG. 1, only one fuel injection valve is shown) and, the remaining part of fuel is returned from the delivery pipe 14 to the fuel tank 10 through return fuel pipes 13*a* through 13*c*. The fuel supply pipes 11*a* through 11*c* are composed of a metal pipe 11*b* which is fastened to the frame of the automobile body and rubber hoses 11*a* and 11*c* connecting the metal pipe 11*b* to the fuel tank 10 and the delivery pipe 14, respectively. Similarly to the fuel supply pipes, the return fuel pipes 13*a* through 13*c* are composed of a metal pipe 13*b* fastened to the frame and rubber hoses 13*a* and 13*b* connecting the metal pipe 13*b* to the fuel tank 10 and the delivery pipe 14, respectively. The rubber hose 13*a* is connected to the cover 10*a* of the maintenance hole of the fuel tank 10.

Numeral 10*d* in FIG. 1 designates a cap which covers an end opening of filling pipe 100 of the fuel tank 10. The filling pipe 100 is composed of a short metal pipe 10*g* welded to the fuel tank 10 and another short metal pipe 10*e* fastened to the automobile body. The metal pipes 10*g* and 10*e* are connected by an intermediate rubber hose 10*f*.

Numerals 5, 6, 7 and 8 indicated by chain lines in FIG. 1 are suction pipes. One ends of the suction pipes 5 through 8 are connected to the portions of an intake air passage upstream of the air cleaner, as explained later. Each of the suction pipes 5, 6, 7 and 8 is extended to the fuel system in FIG. 1 in such a manner that the end apertures of the respective suction pipes face the parts of the fuel system where leaks of fuel could possibly occur. Namely, the suction pipe 5 in FIG. 1 is extended to the filling pipe 100 of the fuel tank and, the end aperture of the pipe 5 faces the surface of the filling pipe 100 with a close clearance therebetween. Similarly to the suction pipe 5, the suction pipes 6 through 8 are extended near the cover 10*a* of the maintenance hole of the fuel tank 10, the rubber hoses 11*c* and 13*c*, respectively.

Further, in this embodiment, collectors 5*a*, 6*a*, 7*a* and 8*a* are provided at the end apertures of the suction pipes 5, 6, 7 and 8, respectively.

The collector 5*a* is a substantially cylindrical shape and disposed at the filling pipe in such a manner that the pipes 10*e*, 10*f*, 10*g* and the cap 10*d* are enclosed by the side wall of the collector 5. The suction pipe 5 is connected to the side wall of the collector 5*a* so that the end aperture of the suction pipe 5 opens inside the collector 5*a*. Both ends of the collector 5*a* are open to the atmosphere. Since the other end of the suction pipe 5 is connected to the intake air passage of the engine, air in the collector 5*a* is drawn into the suction pipe 5 through the end aperture thereof when the engine 1 is operated. This causes ambient air to flow into the collector 5*a* from the both ends thereof. Therefore, the polluting gases, i.e., fuel vapor leaked from the connections between the pipes 10*e*, 10*g* and hose 10*f*, and through the seal between the pipe 10*e* and the cap 10*d*, are drawn into the suction pipe 5 with the ambient air and, thereby, the polluting gases do not diffuse into the atmosphere.

Similarly to the collector 5*a*, the collector 6*a* has a cylindrical shape which surrounds the cover 10*a* and both of the rubber hoses 11*a* and 13*a*. The collector 6*a* extends from the cover 10*a* to the pipes 11*b* and 13*b* beyond the connections between the rubber hoses 11*a*, 13*a* and the pipes 11*b*, 13*b*. One end of the collector 6*a* is attached to the fuel tank 10 and, the other end thereof is open to the atmosphere. The suction pipe 6 is connected to the side wall of the collector 6 so that the end aperture of the suction pipe 6 opens in the collector 6*a*. Therefore, when the engine is operating, the fuel vapor leaked from the connections between the pipe 11*b*, 13*b*, hoses 11*a*, 13*a* and the cover 10*a* is drawn into the suction pipe 6 through the end aperture thereof with the ambient air. The collectors 7*a* and 8*a* to which the suction pipes 7 and 8 are connected, respectively, are similar in configuration to the collector 6*a*. The collectors 7*a* and 8*a* are extended from the delivery pipe 14 to the pipes 11*b* and 13*b* in such a manner that the connections between the delivery pipe 14 and the rubber hoses 11*c*, 13*c*, as well as the connections between the rubber hoses 11*c*, 13*c* and the pipes 11*a*, 13*a* are surrounded by the collectors 7*a* and 8*a*. Therefore, when the engine 1 is operating, the fuel vapor leaked from these connections is drawn into the end apertures of the suction pipes 7 and 8 with the ambient air, and do not diffuse into the atmosphere.

FIG. 2 schematically illustrates the connections between the suction pipes 5 through 8 and the inlet air passage of the engine. In FIG. 2, numeral 21 designates a surge tank of the engine 1 which is connected to the engine 1 by an inlet manifold 23. Numeral 24 shows an intake air passage which connects the surge tank 21 and an air cleaner 25. Numeral 27 in FIG. 2 is an intake nose of the air cleaner 25. The suction pipes 5 through 8 are connected to the side walls of the intake nose 27, therefore, the polluting gases drawn from the respective collectors 5*a*, 6*a*, 7*a* and 8*a* flow into the engine through the air cleaner 25 and the intake air passage 24, and are burned in the engine 1.

Therefore, according to the present embodiment, the polluting gases released from the respective parts of the fuel system are removed before they diffuse into the atmosphere.

Figure 3:
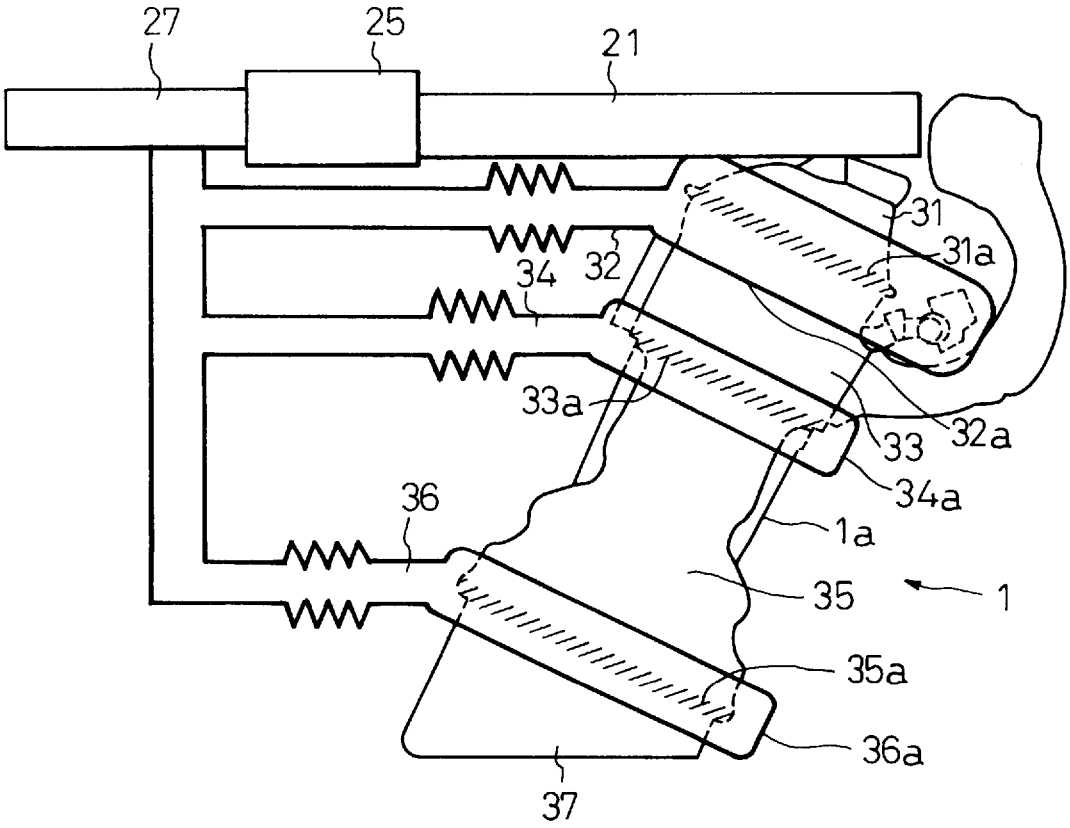
FIG. 3 and FIG. 4 are drawings schematically illustrating an embodiment of the emission control system according to the present invention which is directed to the prevention of diffusion of polluting gases released from the engine body.
Figure 4:
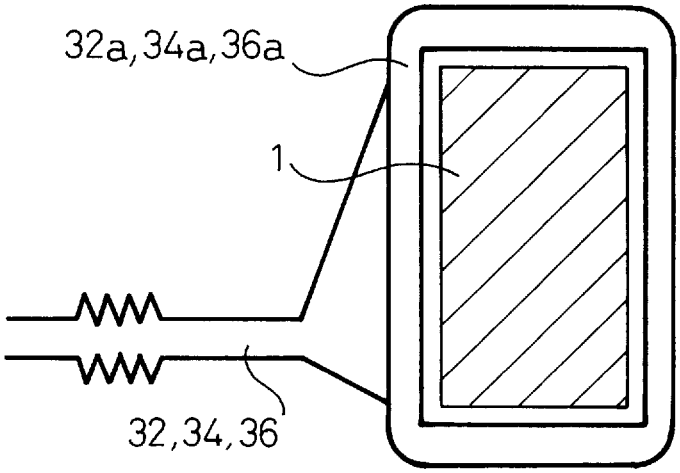

FIGS. 3 and 4 shows an embodiment of the emission control system according to the present invention in which the polluting gases released from the engine body are prevented from diffusing into the atmosphere.

As explained before, when the blow-by gas leaks from the engine through the joints between the parts which compose the engine body or, when the lubricating oil or the cooling fluid of the engine oozes out from these joints, the polluting gases such as hydrocarbons are released into the atmosphere. In this embodiment, the polluting gases caused by the leaks of the joints of the engine body are removed before they diffuse into the atmosphere.

In FIG. 3, line 1*a* shows a contour of the engine 1 when viewing from the crankshaft end. Numerals 31, 33, 35 and 37 designate respective components of the engine, i.e., a rocker cover, a cylinder head, a cylinder block and an oil pan, respectively. The area shown by a hatched portion 31*a* designates a joint between the rocker cover 31 and cylinder head 33. Similarly, hatched portions 33*a* and 35*a* designate joints between the cylinder head 33 and the cylinder block 35 and the cylinder block 35 and the oil pan 37, respectively. At the joints 31*a*, 33*a* and 35*a*, the components 31, 33, 35 and 37 are connected each other via the respective gaskets.

In this embodiment, collectors 32*a*, 34*a*, 36*a* are disposed around the joints 31*a*, 33*a* and 35*a* of the engine, respectively. FIG. 4 schematically shows the shapes of the collectors 32*a*, 34*a* and 36*a*. As shown in FIG. 4, each of the collectors 32*a*, 34*a* and 36*a* consists of a ring-shaped hollow pipe surrounding the outer surface of the engine 1 along the respective joints. The suction pipes 32, 34 and 36 are connected to the collectors 32*a*, 34*a* and 36*a*, respectively. Further, on the surface of the respective collectors, a slit opening which faces the joint is provided. Though not shown in the drawings, the suction pipes 32, 34 and 36 are also connected to the intake nose 27 of the air cleaner in the similar manner to the suction pipes 5 through 8 in FIG. 2. Therefore, the polluting gases released from the joints 31*a*, 33*a* and 35*a* of the engine 1 are drawn into the engine 1 through the collectors 32*a*, 34*a*, 36*a* and the suction pipes 32, 34, 36 and the air cleaner 25, and are burned in the engine 1. Thus, the polluting gases released by the leakage of the blow-by gas or the lubricating oil from the joints of the engine are removed before they diffuse into the atmosphere. Further, according to the present embodiment, since the joints of the components of the engine 1 are covered by the collectors 32*a*, 34*a* and 36*a* along their entire peripheries, the polluting gases released from the joints when the engine is stopped are also trapped by the respective collectors, and thereby, diffusion of the polluting gases into the atmosphere can be prevented to some extent even when the engine is stopped.

Next, another embodiment is explained with reference to FIGS. 5 and 6. In this embodiment, the polluting gases released from the lubricating oil leaked from the elements of the drive system of the automobile, such as a transmission and a differential gear box, are prevented from diffusing into the atmosphere.

Figure 5:
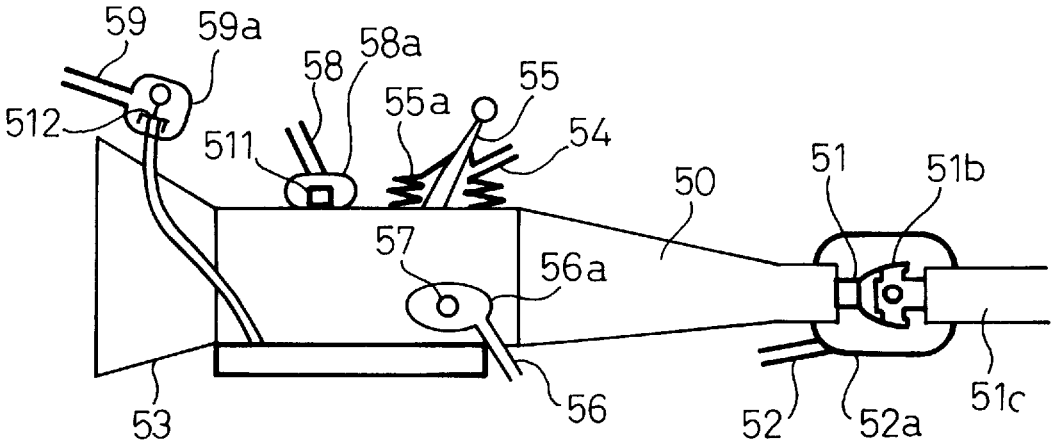
FIGS. 5 through 7 are drawings schematically illustrating embodiments of the emission control system according to the present invention which are directed to the prevention of diffusion of polluting gases released from the elements in the drive system of the automobile.

In FIG. 5, reference numeral 50 shows a transmission of the automobile. An output shaft 51 of the transmission 50 is connected to a propeller shaft 51*c* by an universal joint 51*b*. The transmission 50 is connected to the engine 1 via a clutch not shown in the drawing. Numeral 53 in FIG. 5 shows a clutch cover which encloses the clutch, 57 shows a portion of the transmission housing where the speed meter cable is connected. A shift lever 55 is connected to the transmission 50. In this embodiment, a collector 52*a* which surrounds both the portion of the transmission 50 where the output shaft 51 penetrates the transmission housing and the universal joint 51*b*, and a collector 56*a* which surrounds the portion 57 where the speed meter cable penetrates the transmission housing are provided. As shown in FIG. 5, the propeller shaft 51*c* and the speed meter penetrates the respective collectors 52*a* and 56*a*. Suction pipes 52 and 56 which connects the collectors 52*a* and 56*a* to the intake air passage of the engine 1 are provided. Another suction pipe 54 also connects the inside of a boot 55*a* of the shift lever 55 to the intake air passage of the engine 1.

Numeral 511 and 512 in FIG. 5 designate breathers disposed on the housing of the transmission for adjusting the pressure in the transmission housing. The breather 511 in FIG. 5 is a type which is directly disposed on the housing and the breather 512 is a type which is disposed at the end portion of an oil level gauge of the transmission 50. In this embodiment, collectors 58*a* and 59*a* surround the breathers 511 and 512, respectively, and suction pipes 58 and 59 which connect the collectors 58*a* and 59*a* to the intake air passage of the engine 1 are provided.

The other ends of the suction pipes 52, 54, 56, 58 and 59 are connected to the intake nose 27 of the air cleaner 25 in the similar manner to that in FIG. 2. In this embodiment, the polluting gases such as hydrocarbons are released from the oils which ooze out from the parts of the transmission 50 where the output shaft 51, the speed meter and the shift lever 55 penetrates the transmission housing, as well as from the grease applied to the universal joints 51*b* are drawn into the engine 1 with the ambient air through the respective suction pipes 52, 54 and 56. Further, hydrocarbons such as the oil mist and oil vapor released from the breathers 511 and 512 are drawn into the engine 1 through the suction pipes 58 and 59. Therefore, the polluting gases released from the transmission are removed before they diffuse into the atmosphere.

Figure 6:
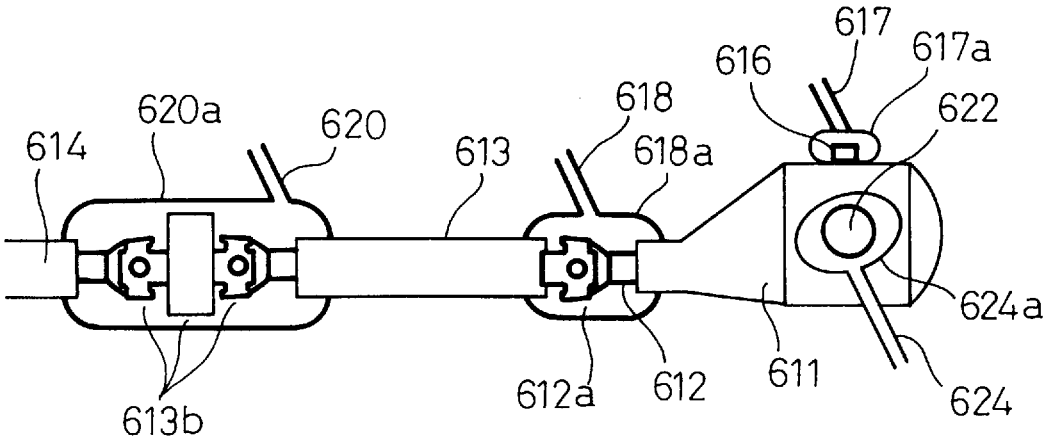

FIG. 6 shows an embodiment in which collectors and suction pipes similar to those in FIG. 5 are disposed on the differential gear box of the automobile. In FIG. 6, numerals 611, 612 and 622 designate a differential gear box, an output shaft of the differential gear box and an input shaft of the differential gear box, respectively (in FIG. 6, only one output shaft is shown). Numeral 612*a* in FIG. 6 is an universal joint which couples the output shaft 612 to an intermediate shaft 613, and numeral 613*b* is a constant velocity joint which couples the intermediate shaft 613 to a drive shaft 614. Numeral 616 designates a breather which is disposed directly on the differential gear box 611. As shown in FIG. 6, a collector 617*a* which surrounds the breather 616, and collectors 612*a*, 620*a* and 624*a* which surround the universal joint 612, the constant velocity joint 613*b* and the input shaft 622 are provided in this embodiment. The collector 617*a* has the construction similar to that of the collector 58*a* in FIG. 5, and the collectors 612*a*, 620*a* and 624*a* have the constructions similar to that of the collector 52*a* in FIG. 5. Suction pipes 612, 620, 624 and 617 which connect the collectors 612*a*, 620*a*, 624*a* and 617*a* to the intake nose 27 of the air cleaner 25 (FIG. 2) are provided. Therefore, similarly to the embodiment in FIG. 5, the polluting gases such as hydrocarbons released from the differential gearbox 611 are drawn into, and burned by, the engine 1 before they diffuse into the atmosphere in this embodiment.

Figure 7:
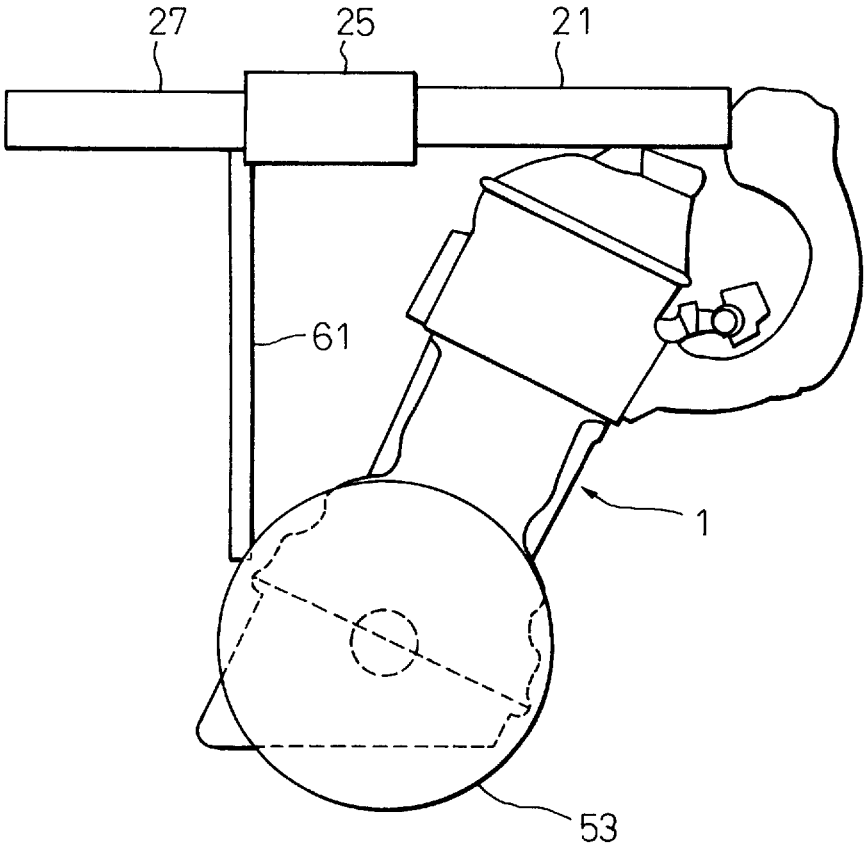

FIG. 7 shows an embodiment of the present invention in which a suction pipe 61 is connected to the clutch cover 53 of the engine 1. The clutch cover 53 surrounds the portion of the engine 1 where the crankshaft penetrates the engine body. At this portion, usually a small amount of engine oil oozes out from an oil seal disposed around the crankshaft, and hydrocarbons are released from the oil. In this embodiment, by connecting the suction pipe 61 to the clutch cover 53, the hydrocarbons released from the oozed oil are drawn into the engine from the inside of the clutch cover 53. Therefore, the hydrocarbons released from the engine are removed before they diffuse into the atmosphere.

In the embodiments in FIGS. 2 through 7, the hydrocarbons released from the oils which have oozed out from various parts of the engine and drive system are drawn into the suction pipe together with ambient air. Therefore, the components of the oil which have low boiling points evaporate in a relatively short time due to airflow caused by the suction pipes, and the residual components of the oil form a gum-like substance around the leaked portion. Thus, a further increase of the oil leak is prevented by the formation of the gum-like substance.

Next, another embodiment of the present invention is explained with reference to FIG. 8. In this embodiment, the polluting gases released from a hydraulic brake system of the automobile are removed before they diffuse into the atmosphere.

Figure 8:
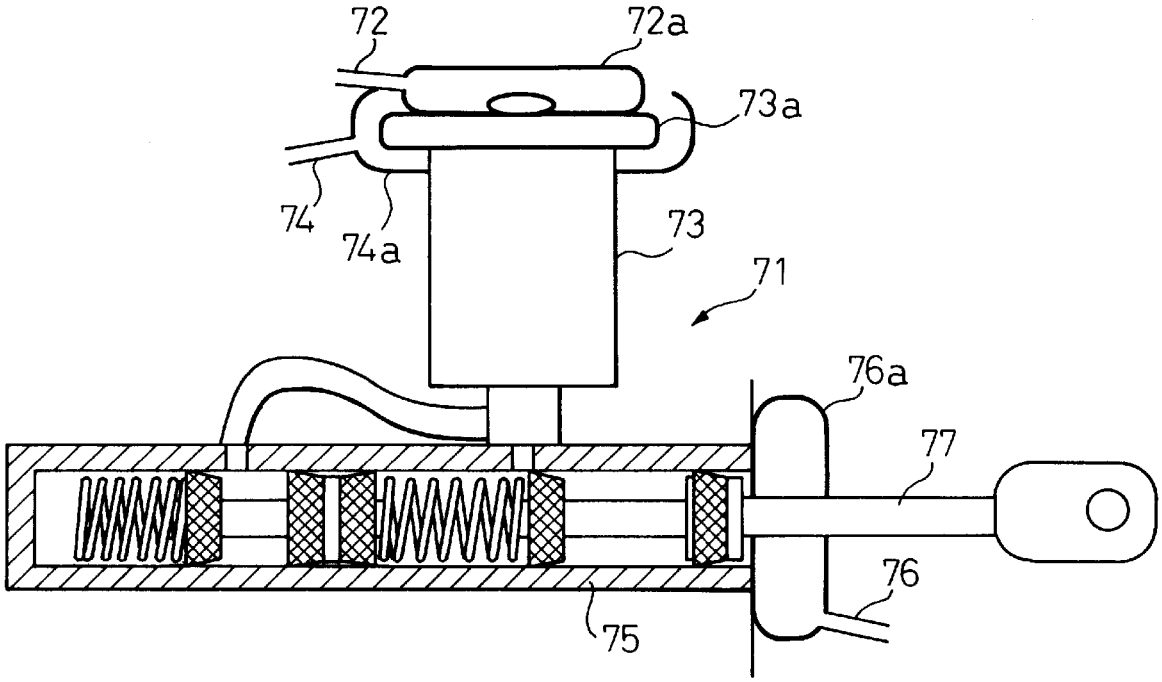
FIG. 8 is a drawing schematically illustrating an embodiment of the emission control system according to the present invention which is directed to the prevention of diffusion of polluting gases released from the brake system of the automobile.

FIG. 8 schematically shows an embodiment of the present invention in which the apertures in the suction pipes are disposed at a master cylinder in the hydraulic brake system. In FIG. 8, a master cylinder, as a whole, is indicated by numeral 71. Numeral 73 is a reservoir for the brake fluid, 73*a* is a cap for the reservoir 71, 75 is a cylinder and, 77 is a push rod which is connected to a brake pedal not shown in the drawing. As shown in FIG. 8, a ring-shaped collector 74*a*, which has a similar construction to that of the collectors in FIGS. 3 and 4, is disposed around the entire periphery of the joint between the cap 73*a* and the reservoir 73. Further, a collector 72*a*, which has the similar construction to that of the collector 58*a*, and a collector 74*a*, which is similar construction to that of the collector 52*a* surround a vent hole of the cap 73*a* and the portion of the cylinder 75 where the push rod 77 is inserted, respectively. The collectors 72*a*, 74*a* and 76*a* are connected to the intake nose 27 of the air cleaner 25 by suction pipes 72, 74 and 76, respectively. Therefore, in this embodiment, the polluting gases released from the brake fluid in the reservoir 73 and the polluting gases released from the brake fluid oozed out from a seal between the cylinder 75 and the push rod 77 are drawn into the engine through the suction pipes 72, 74 and 76 before they diffuse into the atmosphere.

Though FIG. 8 shows the case in which the collectors and suction pipes are disposed on the master cylinder 71, collectors and suction pipes similar to the collector 76*a* and the suction pipe 76 in FIG. 8 may be disposed on the wheel cylinders of the brake system. Further, in addition to the suction pipes and collectors around the master cylinder, suction pipes and collectors similar to 6 and 6*a* in FIG. 1 may be provided on brake fluid pipes to remove the polluting gases released from the brake fluid oozed out from the connections of the brake fluid pipes. If the automobile is equipped with an anti-lock brake system, it is especially preferable to dispose suction pipes and collectors similar to the suction pipe 6 and the collector 6*a* in FIG. 1 at the connections of brake fluid pipes and the elements such as a hydraulic pump and a pressure control valve in the anti-lock brake system.

Figure 9:
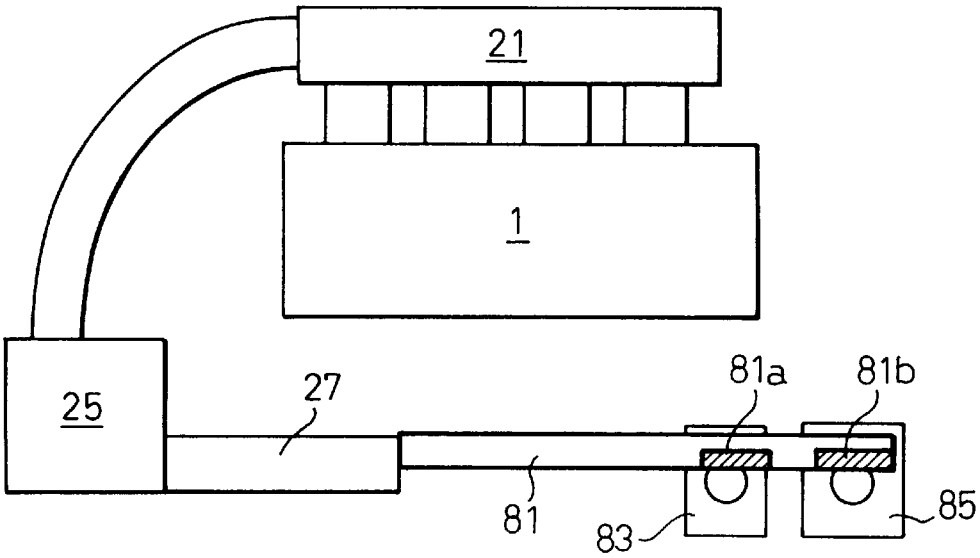
FIG. 9 and FIG. 10 are drawings schematically illustrating embodiments of the emission control system according to the present invention which are directed to the prevention of diffusion of polluting gases released from the auxiliary equipment of the automobile.

Next, FIG. 9 shows an embodiment in which the polluting gases released from reservoirs for engine cooling fluid and windshield washer liquid are removed. In this embodiment, a suction pipe 81 connected to the intake nose 27 of the air cleaner 25 is extended to both the cooling fluid reservoir 83 and the washer liquid reservoir 85 of the automobile. At the portions of the side wall of the suction pipe 81 which face the vent holes of the reservoirs 83 and 85, apertures 81*a* and 81*b*, respectively, are provided as shown in FIG. 9. In this embodiment, the polluting gases released from the engine cooling fluid in the reservoir 83 and the wind shield washer liquid in the reservoir 85 through the vent holes of the respective reservoirs are drawn into the suction pipe 81 through the apertures 81*a* and 81*b*, respectively. Therefore, diffusion of the polluting gases into the atmosphere is prevented from occurring. In addition to the suction pipe 81 in FIG. 9, suction pipes and collectors of similar constructions to the suction pipe 6 and the collector 6*a* may be provided on cooling fluid pipes and wind washer liquid pipes to prevent diffusion of the polluting gases from the connections of these pipes.

Next, an embodiment of the present invention for preventing diffusion of the polluting gases released from the auxiliary equipment, such as equipment in an air conditioning system of the automobile, is explained with reference to FIG. 10.

Figure 10:
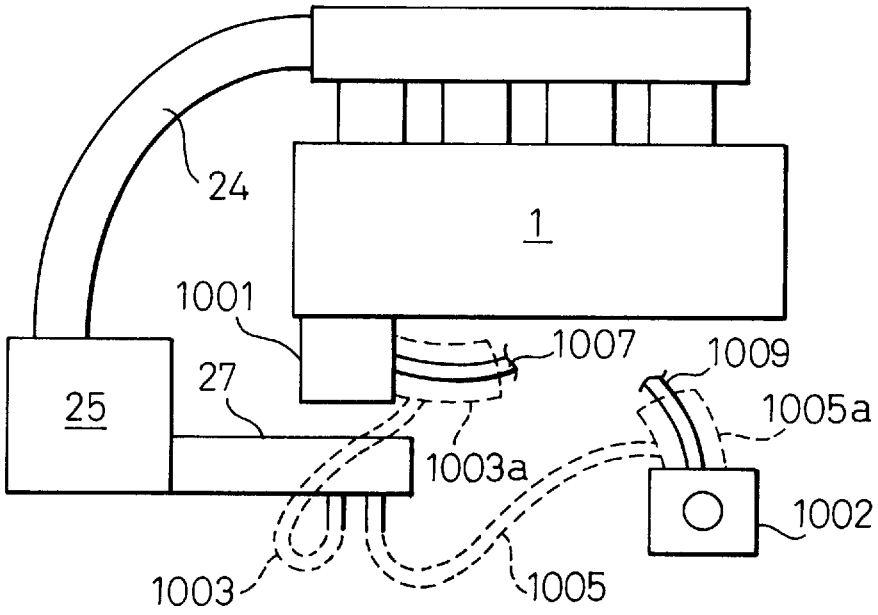

FIG. 10 schematically illustrates an arrangement of the suction pipes and collectors which are directed to the removal of the refrigerant gas leaks from an air conditioning system of the automobile. In FIG. 10, numeral 1001 designates a compressor in the air conditioning system, 1002 designates a reservoir for refrigerant and, 1007 and 1009 designate refrigerant pipes which connects the equipment in the air conditioning system each other. In this embodiment, collectors 1003*a* and 1005*a* which have constructions similar to that of the collector 6*a* in FIG. 1 are disposed at the portions of the compressor 1001 and the reservoir 1002 where the refrigerant pipes 1007 and 1009 are connected. The collectors 1003*a* and 1005*a* are connected to the intake nose 27 of the air cleaner 25 by suction pipes 1003 and 1005. In this arrangement, the refrigerant gas such as chlorofluorocarbon gas leaked from the connections between the refrigerant pipes 1007, 1009 and the equipment 1001 and 1002 is drawn into the engine through the suction pipes 1003 and 1005. Therefore, the polluting gases such as the refrigerant gas are removed before they diffuse into the atmosphere.

Though not shown in FIG. 10, collectors similar to 1003*a*, 1005*a* and suction pipes similar to 1003 and 1005 may be disposed at the connections between the refrigerant pipes and other equipment in the air conditioning system, such as an evaporator and a condenser, to prevent diffusion of the polluting gases leaked therefrom.

Further, the polluting gases may be released from auxiliary equipment other than those of the air conditioning system. For example, auxiliary equipment such as a power window systems or automatic seat adjusting systems use electric motors. These electric motors usually contain lubricants such as lubricating oil and grease applied to bearings, and the polluting gases may be released from these electric motors. Therefore, collectors and suction pipes may be disposed at the auxiliary equipment to remove the hydrocarbons released from the lubricants of the electric motors.

Next, embodiments of the present invention for removing the polluting gases released from interior and exterior parts of the automobile is explained.

Figure 11:
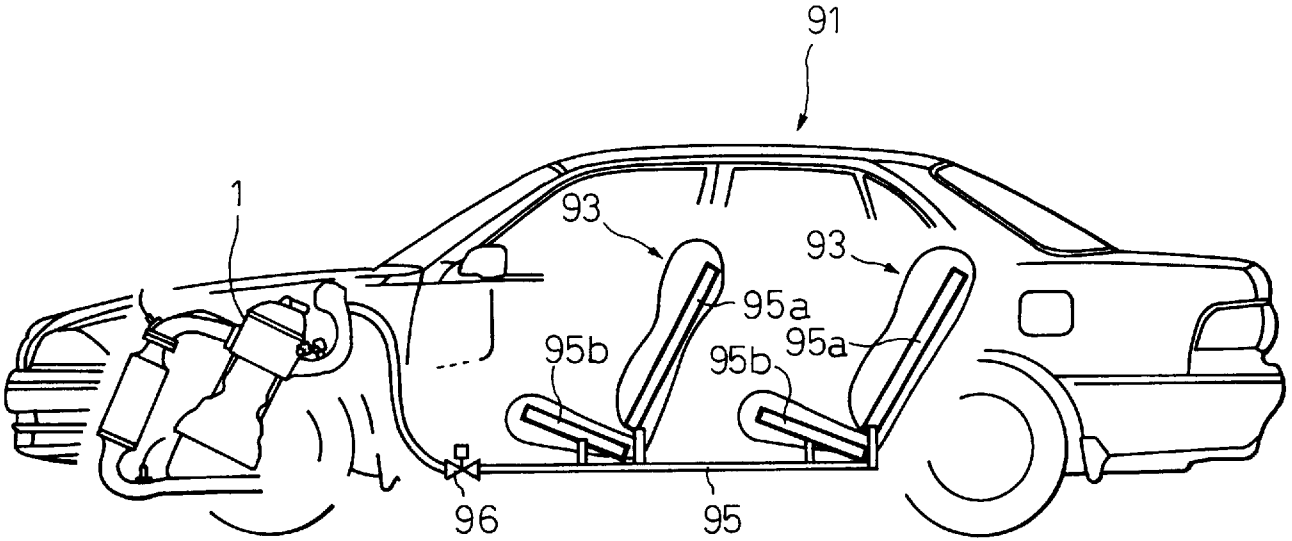
FIGS. 11 through 13 are drawings schematically illustrating an embodiment of the emission control system according to the present invention which is directed to the prevention of diffusion of polluting gases released from the interior parts of the body of the automobile.
Figure 12:
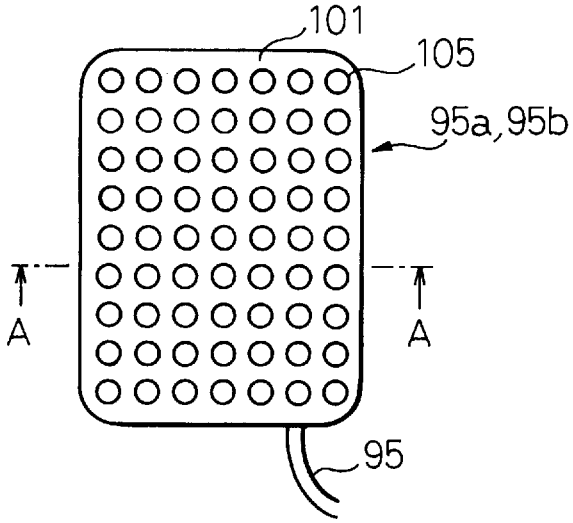
Figure 13:
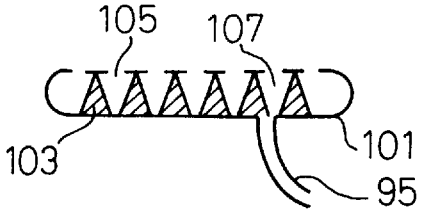

FIGS. 11 through 13 illustrate an embodiment in which the polluting gases released from interior parts, especially from the seats of the automobile are removed. As explained before, some of the materials used in the seats of the automobile use solvents in the production process, further, adhesives containing solvents are used for fabricating the seats. Therefore, the residual solvents contained in the materials of the seats and the adhesives used for fabricating the seats are released from the seats into the atmosphere. In this embodiment, the polluting gases such as solvent vapor released from the seats are removed before they diffuse into the atmosphere.

In FIG. 11, numeral 91 indicates an automobile as a whole, 93 designates the seats disposed in the compartment of the automobile 91. In this embodiment, as shown in FIG. 11, collectors 95*a* and 95*b* are disposed inside of the seat back and seat cushion of the seat 93, respectively. The collectors 95*a* and 95*b* are connected to the intake nose of the air cleaner of the engine 1 by a suction pipe 95. Further, a flow control valve 96 is disposed in the suction pipe 95 in this embodiment.

FIGS. 12 and 13 show the construction of the collectors 95*a* and 95*b* in FIG. 11. The collectors 95*a* and 95*b* in this embodiment are box-shaped assemblies made of flexible plates 101. On the plates 101, a number of apertures 105 which communicate with air passages 107 in the collectors are disposed as shown in FIGS. 12 and 13. Further, cushion materials 103 are disposed in the collectors 95*a* and 95*b*. When the engine is operated, ambient air is drawn into the engine 1 through the apertures 101, air passages 107 and the suction pipe 95. Therefore, the polluting gases released from the residual solvent in the seats, together with the ambient air are drawn into the suction pipe 96 through the apertures 101, and burned by the engine. Thus, the polluting gases released from the seats are removed before they diffuse into the atmosphere.

Further, in the compartment of the automobile, the polluting gases are released from various interior parts. For example, materials such as synthetic resin and rubber release the solvents which are used for producing these materials and remain therein. Also, adhesives and paints used for fabricating the interior parts contains solvents, and release solvents vapor to the atmosphere in the compartment. According to the present embodiment, these solvent vapors released from the interior parts in the compartment are also drawn into the engine through the collectors 95*a*, 95*b* and the suction pipe 95. Therefore, diffusion of the polluting gases released from the interior parts of the automobile can be also prevented.

In addition to the removal of the polluting gases, according to this embodiment, since the seats are always kept at a dry condition by the air flows through the seat backs and seat cushions, the hygiene and comfort of the automobile seats are greatly improved. Further, if the control valve as shown by numeral 96 which controls the amount of air flows through the suction pipe 95 is provided, the comfortableness of the compartment can be further improved.

Figure 14:
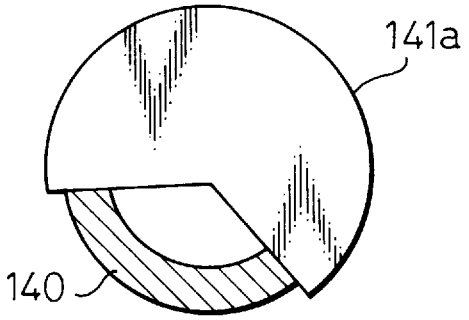
FIGS. 14 through 16 are drawings schematically illustrating an embodiment of the emission control system according to the present invention which is directed to the prevention of diffusion of polluting gases released from the exterior parts of the body of the automobile.
Figure 15:
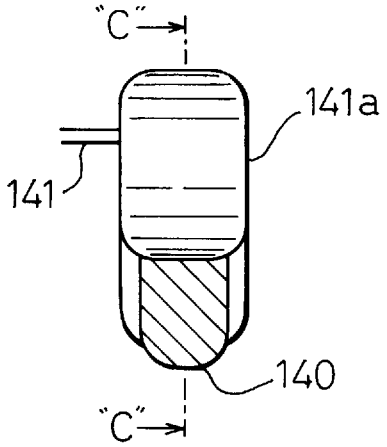
Figure 16:
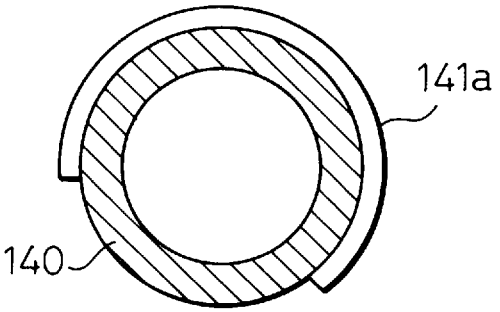

FIGS. 14 through 16 show another embodiment in which the polluting gases released from exterior parts of the automobile are removed. This embodiment is directed to the removal of the polluting gases released from tires, i.e., typical exterior parts of the automobile. In this embodiment, collector 141*a* as shown in FIGS. 14 through 16 is disposed at each of the tires 140 of the automobile. FIGS. 14 and 15 show a front view and a side view, respectively, of the collector 141*a* according to this embodiment, and FIG. 16 shows a sectional view taken along a line C—C in FIG. 15.

As shown in FIGS. 14 through 16, the collectors 141*a* cover the surfaces of the respective tires 140 except around the parts where the respective tires contact the ground. The collectors 141*a* are connected to the intake nose 27 of the air cleaner 25 by the respective suction pipes 141. Therefore, the polluting gases released from the tires are drawn into the engine through the collectors 141*a* and the suction pipes 141. Thus, the polluting gases, such as solvent vapor and hydrocarbons released from the tires are removed before they diffuse into the atmosphere. When the collectors 141*a* as shown in FIGS. 14 through 16 are used, foreign matter such as mud, water or dust may be also drawn into the suction pipes 140. This may cause the blockage of the suction pipes. Therefore, separators for eliminating the foreign matters from being drawn into the suction pipes, such as a centrifugal type separator may be disposed in the respective suction pipes to prevent the blockage of the suction pipes.

Next, embodiments in which the polluting gases released from the elements in the chassis system of the automobile are explained with reference to FIGS. 17 through 20. In this specification, the term "chassis system" means any mechanism of the automobile other than the engine, the drive system and the auxiliary equipment. For example, the chassis system includes a steering system, a suspension system and a brake system of the automobile. With regards to the equipment in the chassis system, the embodiment for preventing diffusion of the polluting gases from the brake system was already explained in FIGS. 8 and 9. Therefore, only embodiments for preventing diffusion of the polluting gases from the steering system and the suspension system are explained hereinafter.

Figure 17:
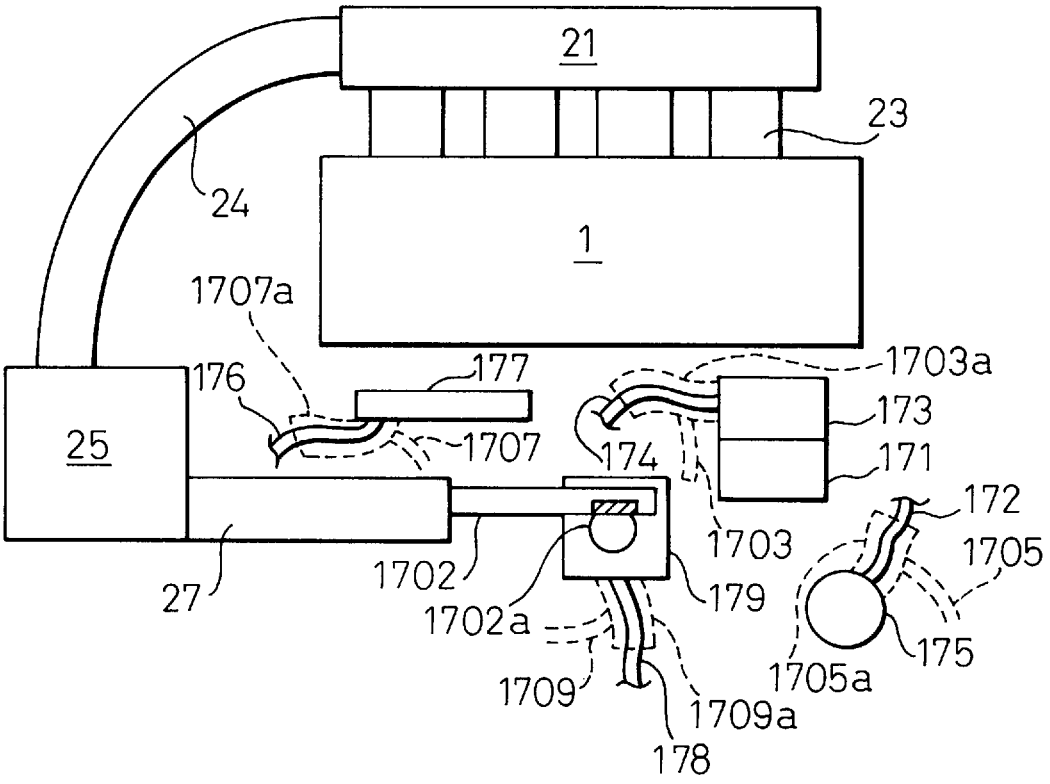
FIGS. 17 through 20 are drawings schematically illustrating embodiments of the emission control system according to the present invention which are directed to the prevention of diffusion of polluting gases released from the chassis elements of the automobile.

FIG. 17 shows an embodiment in which suction pipes and collectors are disposed at the equipment in the power steering system of the automobile. In FIG. 17, numeral 171 shows a steering gear box which is connected to a steering column (not shown in the drawing), 173 shows a control valve associated with the gear box 171. Numerals 175 and 179 designate a hydraulic pump for pressurizing working fluid in the power steering system, and a reservoir for the working fluid (power steering fluid), respectively. Numeral 177 shows a power cylinder (a hydraulic cylinder) for actuating the steering mechanism. The pump 175 and the control valve 173, the control valve 173 and the power cylinder 177, the power cylinder 177 and the reservoir 179 and, the reservoir 179 and the pump 175, respectively, are connected each other by working fluid pipes. FIG. 17 shows only one working fluid pipe for the respective equipment 171 through 179 for clarity (i.e., the pipes 172, 174, 176 and 178). In this embodiment, the collectors similar to the collectors 6*a* and 7*a* in FIG. 1 are disposed at the connecting portions between the respective equipment and the working fluid pipes. (FIG. 17 shows only the collectors 1703*a*, 1705*a*, 1707*a* and 1709*a* disposed on the pipes 174, 172, 176 and 178, respectively). The respective collectors are connected to the intake nose 27 of the air cleaner 25 by suction pipes (1703, 1705, 1707 and 1709). Further, another suction pipe 1702 is extended to the portion near a filler cap of the reservoir 179, and an aperture 1702*a* is disposed on the wall of the suction pipe 1702 facing the cap of the reservoir 179. Therefore, the polluting gases released from the working fluid which oozes out from the connections of the pipes and equipment in the power steering system are drawn into the engine through the suction pipes before they diffuse into the atmosphere.

Figure 18:
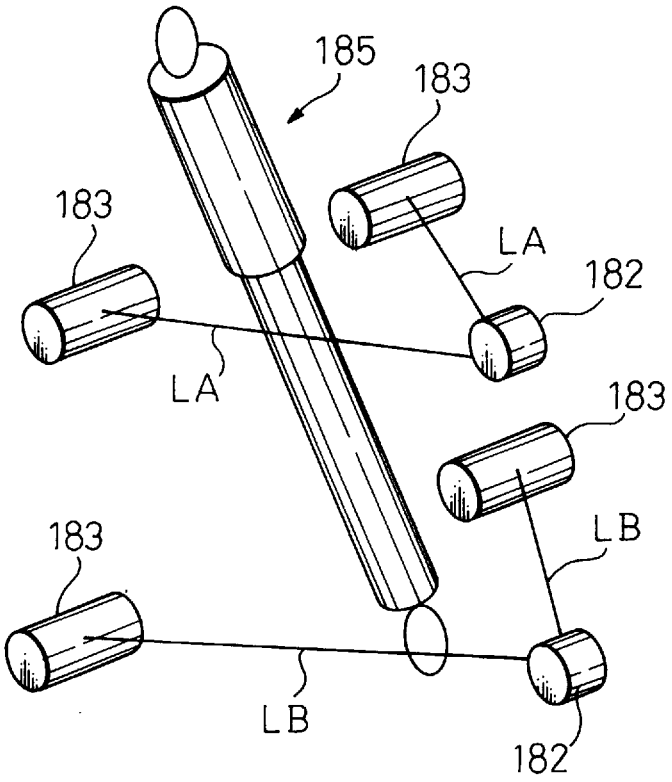
Figure 19:
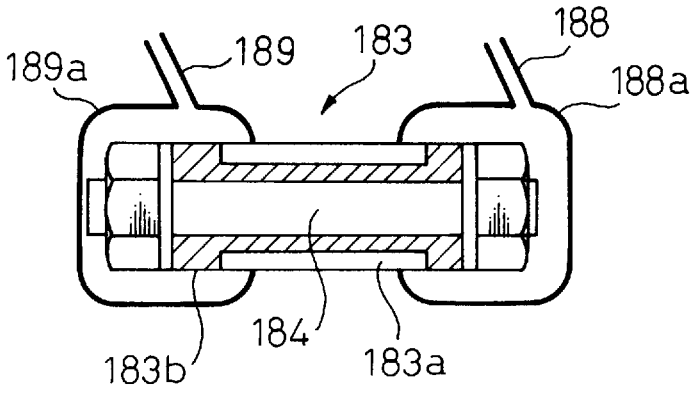
Figure 20:
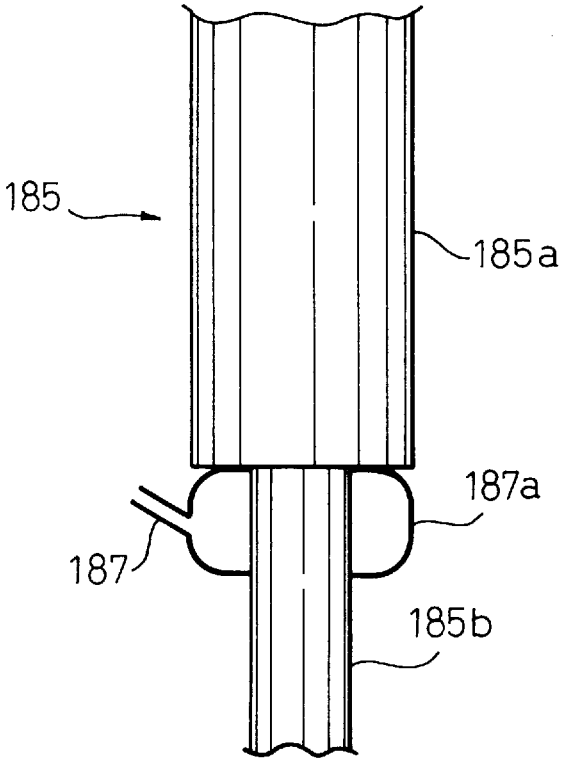

FIGS. 18 through 20 show an embodiment of the present invention in which the polluting gases are released from the suspension system of the automobile. In FIG. 18, LA and LB designate suspension arms which connect a wheel to the frame of the automobile, 183 and 182 designate bushings for connecting the suspension arms LA and LB to the frame and the wheel, respectively. Further, a shock absorber 185 which connects the lower arm LB and the frame is provided. In this embodiment, collectors and suction pipes are disposed on the respective bushings 183 and 182, as well as on the shock absorber 185.

FIG. 19 schematically shows a collectors 188*a* and 189*a* and suction pipes 188 and 189 disposed on the bushing 183. The collectors 188*a* and 189*a* are disposed at the both ends of the bushing 183 in such a manner that both ends of a sleeve 183*a* and a rubber bush 183*b*, as well as a fastening bolt 184 are covered by the collectors 188*a* and 189*a*. The collectors 188*a* and 189*a* are connected to the intake nose 27 of the air cleaner in the similar manner to the suction pipes 5 through 8 in FIG. 2. Therefore, the polluting gases such as hydrocarbons released from grease sealed in the bushing 183 and from the rubber bush 183*b* are drawn into the engine 1 through the suction pipes 188 and 189 before they diffuse into the atmosphere. Though not shown in the drawing, collectors and suction pipes similar to the collectors 188*a*, 189*b* and suction pipes 188 and 189 are disposed on the bushings 182 on the wheel side.

FIG. 20 schematically shows a collector 187*a* and a suction pipe 187 disposed on the shock absorber 185. The collector 187*a* has a construction similar to that of collector 76*a* in FIG. 8, and surrounds the portion of the shock absorber where the rod 185*b* are inserted into the cylinder 185*a*. The suction pipe 187 connects the collector 187*a* to the intake nose 27 of the air cleaner 25. Therefore, the polluting gases released from working fluid in the cylinder 185*a* which oozes out from the seal between the cylinder 185*a* and the rod 185*b* are drawn into the engine 1 through the suction pipe 187, and the polluting gases released from the shock absorber are removed before they diffuse into the atmosphere.

If the automobile is equipped with an hydraulic mechanism for adjusting the ground clearance of the automobile or the damping factors of the shock absorbers, collectors and suction pipes similar to the collector 6*a* and the suction pipe 6 in FIG. 1 may be provided at the connections of the hydraulic pipes and the equipment in addition to the collectors and suction pipes in FIGS. 18 through 20.

Further, various parts of chassis system, especially sliding parts such as door hinges, engine hood hinges, trunk lid opener cables and door lock mechanisms are applied with lubricating oils or greases, and the polluting gases such as hydrocarbons are released from these sliding parts. Therefore, collectors and suction pipes may be provided on these sliding parts to remove the polluting gases before they diffuse into the atmosphere.

Though the suction pipes are connected to the intake nose of the air cleaner in the above embodiments, the suction pipes may be connected to the intake air passage 24 (FIG. 2) of the engine 1 at the portion downstream of a throttle valve in order to increase the sucking capability of the suction pipes. Similarly, in order to increase the sucking capability, a suction pump (an air pump) may be provided on the suction pipes to drawn the polluting gases into the suction pipes and to send these gases into the intake air passage of the engine. Further, separators such as centrifugal type separators may be provided on the suction pipes in order to prevent the entry of foreign matter (such as mud, water and dust) into the intake air passage.

As explained above, according to the present invention, since the polluting gases released from various parts of the automobile are drawn into the engine through the suction pipes having apertures facing these parts before they diffuse into the atmosphere and they are burned by the engine. Therefore, diffusion of the polluting gases from the automobile can be prevented from occurring.

We claim:

1. An emission control system for an automobile for preventing polluting gases released from an automobile from diffusing in the atmosphere, comprising;

a suction pipe connected to an air intake passage of an engine of the automobile, the suction pipe extending to a part of the automobile from where polluting gases are released, an aperture provided on said suction pipe, said aperture facing the surface of said part and being spaced apart from and substantially adjacent said part so that the polluting gases released from said part into ambient air and the ambient air around said part are drawn into the engine through the aperture and the suction pipe when the engine is operating.

2. An emission control system according to claim 1, wherein said aperture faces an outer surface of at least one of the elements in a fuel system of the engine.

3. An emission control system according to claim 1, wherein said aperture faces the outer surface of the engine.

4. An emission control system according to claim 1, wherein said aperture faces an outer surface of at least one of the elements in a coolant recirculation system of the engine.

5. An emission control system according to claim 1, wherein said aperture faces an outer surface of at least one of the elements in a drive system of the automobile.

6. An emission control system according to claim 1, wherein said aperture faces an outer surface of at least one of the elements in a chassis system of the automobile.

7. An emission control system according to claim 6, wherein said aperture faces an outer surface of at least one of the elements in a brake system of the automobile.

8. An emission control system according to claim 6, wherein said aperture faces an outer surface of at least one of the elements in a steering system of the automobile.

9. An emission control system according to claim 6, wherein said aperture faces an outer surface of at least one of the elements in a suspension system of the automobile.

10. An emission control system according to claim 1, wherein said aperture faces an outer surface of at least one auxiliary equipment of the automobile.

11. An emission control system according to claim 10, wherein said aperture faces an outer surface of at least one of the elements in a windshield washer system.

12. An emission control system according to claim 10, wherein said aperture faces an outer surface of at least one of the elements in an air conditioning system.

13. An emission control system according to claim 1, wherein said aperture faces an outer surface of at least one of the interior and exterior elements of the body of the automobile made of a material containing solvent.

14. An emission control system according to claim 13, wherein said material is any of adhesive, synthetic resin, rubber and paint.

15. An emission control system according to claim 13, wherein said aperture faces an outer surface of a tire of the automobile.

16. The apparatus of claim 1, wherein said suction pipe does not extend within said part.

17. The apparatus of claim 1, wherein the suction pipe and the aperture suck in only polluting gases released from said part and ambient air surrounding said part.

18. The apparatus of claim 16, wherein the collector includes two open ends.

19. The apparatus of claim 16, wherein said collector surrounds an outer surface of at least one of a windshield wiper system and an air conditioning system.

20. An emission control system for an automobile for preventing polluting gases released from the automobile from diffusing in the atmosphere, comprising:

a suction pipe being connected to an intake air passage of an engine of the automobile, the suction pipe extending to a part of the automobile from where the polluting gases are released, the suction pipe not connecting to or extending within said part;

an aperture extending from the suction pipe and being in close proximity to the part; and a collector attached to the aperture and substantially surrounding the part, the polluting gases released from the part and ambient air around the part being drawn into the engine through the collector when the engine is operating.

* * * * *